US005242219A

United States Patent [19]

Tomaka

[11] Patent Number: 5,242,219

[45] Date of Patent: Sep. 7, 1993

[54] BETWEEN RAFTERS STORAGE DEVICE

[76] Inventor: Leonard P. Tomaka, 175 E. Delaware Pl. #4817, Chicago, Ill. 60611

[21] Appl. No.: 857,978

[22] Filed: Mar. 26, 1992

[51] Int. Cl.[5] ..... A47F 5/08

[52] U.S. Cl. ..... 312/245; 52/32; 52/39; 220/485

[58] Field of Search ..... 312/245, 246, 322, 334.29, 312/334.27, 410, 408, 402; 52/32, 39, 702; 220/478, 479, 485; 248/293, 298; 108/143; 211/94, 94.5, 162

[56] References Cited

U.S. PATENT DOCUMENTS

| | | | |
|---|---|---|---|
| 1,044,704 | 11/1912 | Stoddard | 248/293 |
| 1,137,074 | 4/1915 | Morris . | |
| 1,188,987 | 6/1916 | Persons | 248/298 |
| 2,994,439 | 8/1961 | Koley | 108/143 |
| 3,627,398 | 12/1971 | Reese | 312/246 |
| 3,975,071 | 8/1976 | Quinn | 108/143 |
| 4,285,557 | 8/1981 | Paladino et al. . | |
| 4,446,660 | 5/1984 | Miller et al. | 52/36 |
| 4,467,926 | 8/1984 | Percival | 211/94.5 |
| 4,653,818 | 3/1987 | DeBruyn . | |
| 4,699,437 | 10/1987 | Genereaux | 312/248 |
| 4,725,108 | 2/1988 | Wilson . | |
| 4,733,925 | 3/1988 | Duran et al. . | |
| 5,011,239 | 4/1991 | Guerin . | |
| 5,039,902 | 8/1991 | Schwarz . | |

*Primary Examiner*—Kenneth J. Dorner
*Assistant Examiner*—Janet M. Long
*Attorney, Agent, or Firm*—Richard G. Kinney

[57] ABSTRACT

A storage device for use between exposed rafters of a basement or like ceiling is disclosed. The device includes a base and drawer each of rigid welded wire construction. The base is secured by wood screws to the bottom surface of adjacent rafters to span between them. The base includes tracks in the form of welded wires which define a pair of parallel slots. The wires also define an enlarged opening into the slots of the front end of the base. The drawer at the bottom of its rear end has a pair of spaced apart projecting T-shaped hooks for releasably and slidably engaging the track. The hooks also allow the drawer to hang vertically from the front end of the base and to be manually removed and reinserted into engaging with the slots through the wide openings. The drawer may be pivoted upward on the hooks and slid with the hooks engaged in the slots to a storage position atop the base and between the rafters. The unit's welded wire construction allows the drawer's contents to be readily seen from below even when the drawer is in the storage position between the rafters. The drawer is formed with security lip at its front end of its mostly open top to help keep stored items in the drawer even when it is hanging generally vertically from the base for easy access.

18 Claims, 3 Drawing Sheets

BETWEEN RAFTERS STORAGE DEVICE

FIELD OF THE INVENTION

The present invention relates to storage supports and is especially concerned with a storage device for using the often wasted space between exposed rafters.

BACKGROUND OF THE INVENTION

Storage space always seems to be in demand. It has been suggested to use for storage the space between exposed rafters in basements or elsewhere. See, for example, U.S. Pat. Nos. 4,446,660; 4,699,437; and 5,039,902. Such prior art devices have not become widely accepted, as they suffer from one or more drawbacks. They are inconvenient to install, requiring installing of screws or nails into the sub floor deep between the rafters, or into the side walls of the rafters. As the spacing between rafters is typically 16 inches (on centers) the opening is typically about 14½ inches leaving little room to conveniently set a nail and swing a hammer on its head, nor is the room sufficient to place most conventional electric drill for drilling a screw pilot hole. While specialized tools such as a right angle drive for an electric drill are available, these are often not conveniently available to the average homeowner. Some prior art units require careful measuring to make sure the parts, when installed, will align with one another. Many times, ordinary house-holders find such measuring difficult, resulting in the need to remove and reinstall some parts to the rafters when it is discovered that the measurements were made incorrectly.

The prior art storage inter-rafter units besides being difficult to install are often difficult and expensive to make, requiring specialized castings or machined parts or if made of inexpensive materials (as in the case of the device of U.S. Pat. No. 4,446,660—cardboard) have a limited weight capacity and limited useful life and are subject to mold, vermin and dampness damage.

Thus there exists a need for an overhead between rafter storage unit which is economical to make, easy to install by an unskilled person and yet yields a storage unit of high weight capacity, long life, and is not itself susceptible to vermin infestation or rot.

SUMMARY OF THE INVENTION

In overcoming one or more of the drawbacks of the prior art and satisfying some or all of the above stated needs, a storage device constructed in accordance with the principles of the present invention includes a base unit and a drawer unit. The base is sized to span across an adjacent pair of rafters and extend under the rafters bottom edges. Means, such as a set of four screws, one at each corner, secure the base in place. The base further includes track means, such as a pair of spaced apart slots, running approximately parallel to and between the rafters. The drawer unit includes means for engaging the base track means which allows the drawer to be moved along the track from a horizontal position above the base and between the rafters to a generally vertical position where it depends from one end of the base for ease of adding or removing items from the drawer.

The invention, together with further advantages and features thereof, may best be understood by reference to the following description taken in connection with the accompanying drawings, in the several figures of which like reference numerals identify like elements.

DETAILED DESCRIPTION OF ONE PREFERRED EMBODIMENT

Figure 1:
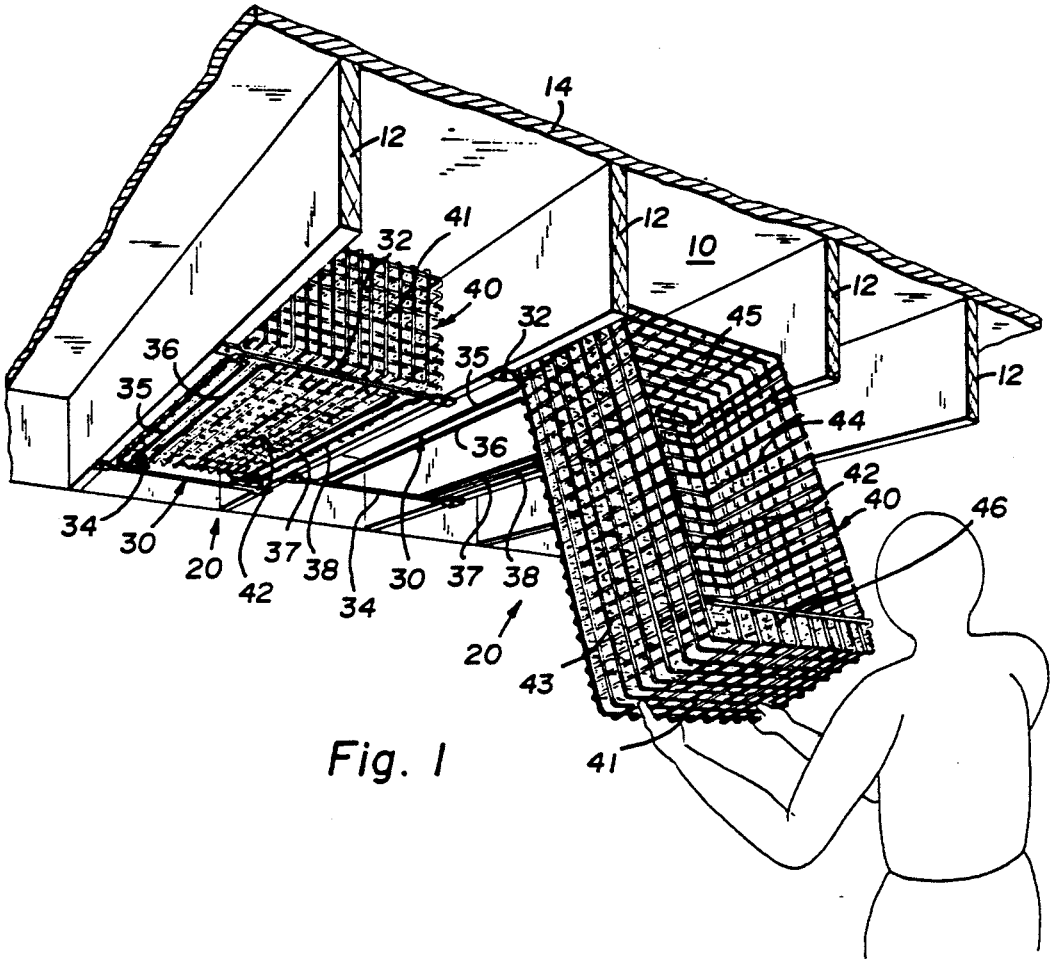
FIG. 1 is a perspective view of a ceiling (shown partly cut away) with exposed rafters, between which are secured two identical storage devices, both of which are constructed in accordance with the present invention and one of which is shown with its drawer positioned entirely between rafters and the other of which is shown with its drawer hanging down and held by a human user who is depicted in outline form.

Referring to the figures and especially to FIG. 1, there is depicted an unfinished ceiling 10 of the type which is common in basements and garages. The ceiling 10 consists of exposes parallel rafters 12 with a floor or subfloor 14 atop them. Typically the rafters are "two by twelves" or "two by tens" spaced apart 16 inches on centers. This volume of space between the rafters and under the floor 14 is often not used for any purpose.

In FIG. 1, two devices 20 are depicted, each of which is identical in construction and appearance and each of which is constructed in accordance with the principles of the present invention. The device 20 includes a base unit 30 and a drawer unit 40. During storage the drawer unit 40 is secured atop the base 30 as shown in the left side of FIG. 1. However the drawer may be slid out and pivoted downward as shown in the right side of FIG. 1, to allow easy access to its contents or for loading goods into it.

Each of the drawer units 40 has a front wall 41, a bottom 42, a left side wall 43, a right side wall 44, a rear wall 45, and has a short security lip 46 across the top of the front wall 41 between and connected to the top edges of the side walls 43, 44. The security lip helps in preventing inadvertent spillage of items from the drawer 40 when it is moved into a near vertical position.

Figure 2:
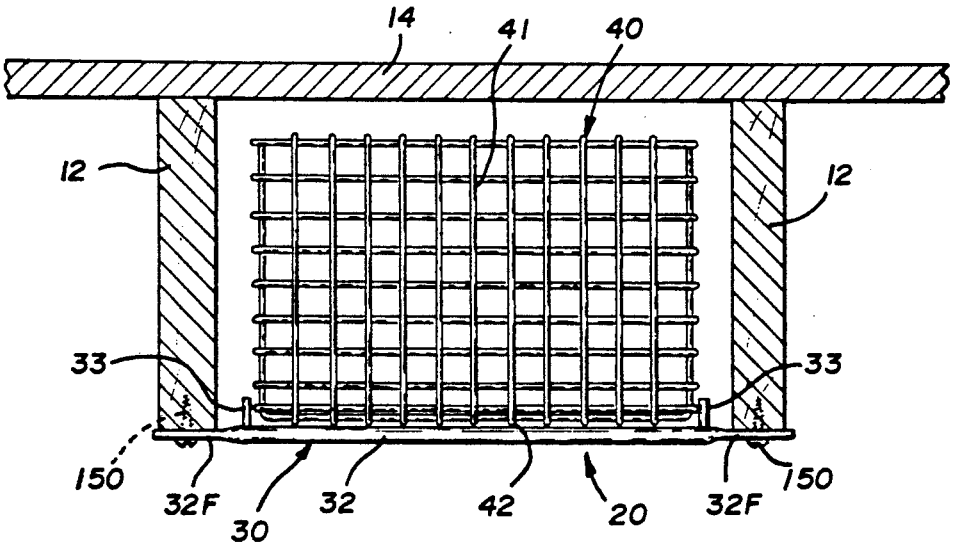
FIG. 2 is an end elevational view of one of the installed devices of FIG. 1 with rafters and subfloor shown in section and fasteners shown in outline.
Figure 3:
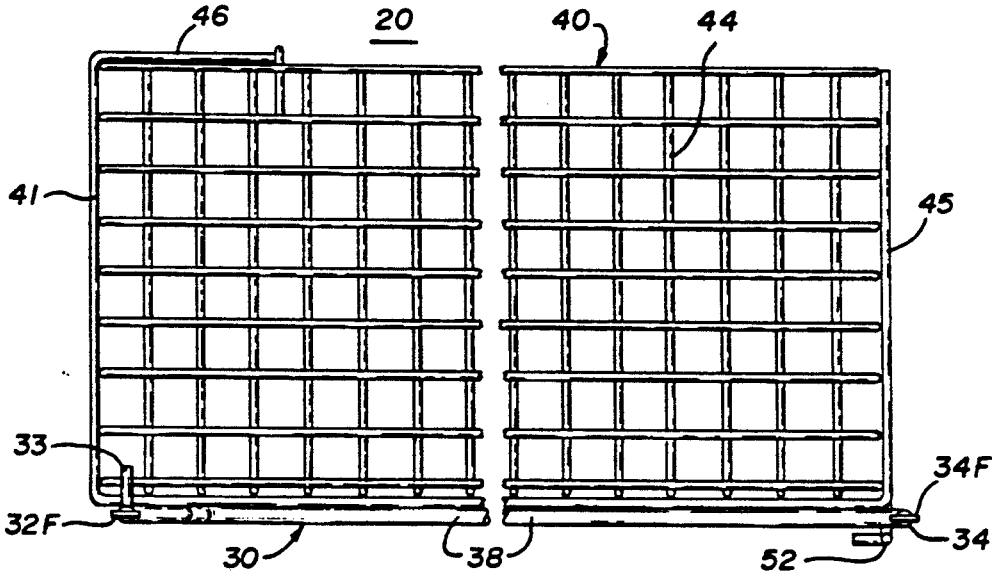
FIG. 3 is a side elevational view of the device of FIGS. 1 and 2 with an internal section broken away so as to show greater detail of the end portions of the device.
Figure 4:
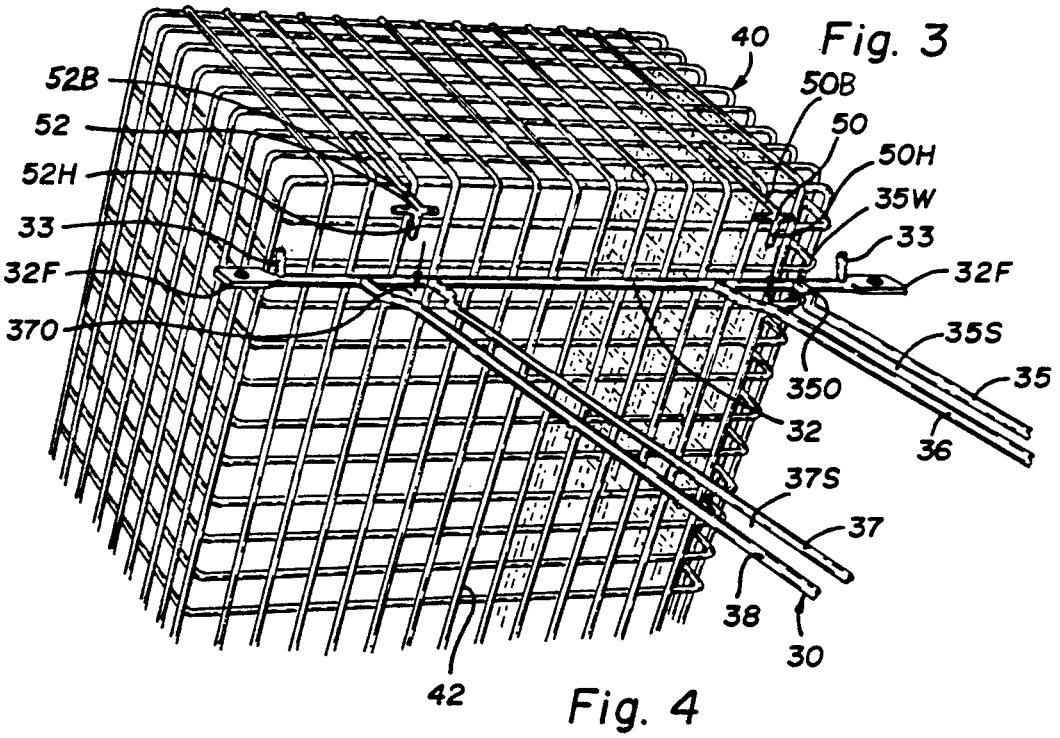
FIG. 4 is a perspective view of a portion of the base unit and of the drawer unit illustrating the method of releasably affixing the two units together.

As shown better in FIGS. 2–4, the base 30 includes a front crossmember 32 and rear crossmember 34 sized to span across adjacent rafters and each of which crossmember terminates on a flattened flange 32F, 34F which fits under the bottom of the rafters 12. The base flanges 32F, 34F are slotted to allow the base 30 to be secured to the rafters by four vertical screws such as the two screws 150 shown in FIG. 2. The front crossmember 32 also has a pair of upstanding guides 33 which serve to allow the drawer 40 to loosely fit between them and serve to help guide the track engaging means of the drawer unit 40 into tracks formed by the base and also helps guide the drawer unit 40 when it is moved between the storage and access positions shown in FIG. 1.

The base 30 also includes track defining means namely a set of four rigid wire or rod members 35, 36, 37 and 38 which are best shown in FIGS. 4 and 1. The rod members 35 and 36 define a slot 35S running between crossmember 32 and 34. And the rod members 37 and 38 define a similar slot 37S. The rods 35 and 38 are for most of their length parallel to one another and, when the base is installed on rafters, approximately parallel to the rafters. The base 30 is preferably formed from rigid wire stock and has its members welded together. Thus as shown in FIG. 4 the rod 35 is preferred spot welded to crossmember 32 at 35W and the other seven places of juncture between the rods 35–38 and the crossmembers are likewise welded. This provides a strong rigid structure especially after the base is secured to the rafters with the screws 150. The ability to secure the base by vertical fasteners to the bottom most surfaces of the rafters makes the base easy to install. No special tools are needed and sufficient space is normally present to allow easy access by a vertically operated electric drill (to drill pilot holes) and to drive the fasteners.

In accordance with a feature of the present invention the back rear of the drawer 40 is provided with a pair of track engagement means 50, 52 end of which includes a hook extension 50H, 52H and a slot engaging bar 50B, 52B.

Figure 5:
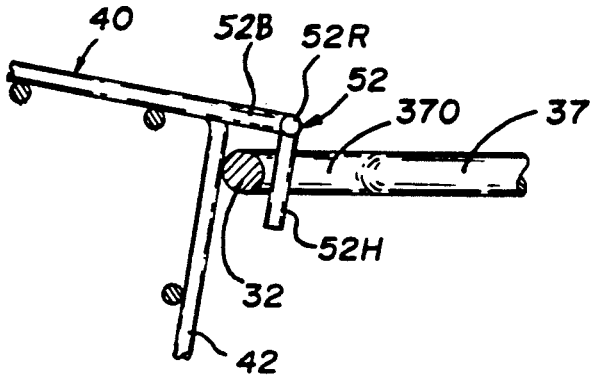
FIG. 5 is a fractional sectional view of the portion of the drawer unit and a portion of the base unit of FIGS. 1–4 illustrating the initial step in assembling the two units together.
Figure 6:
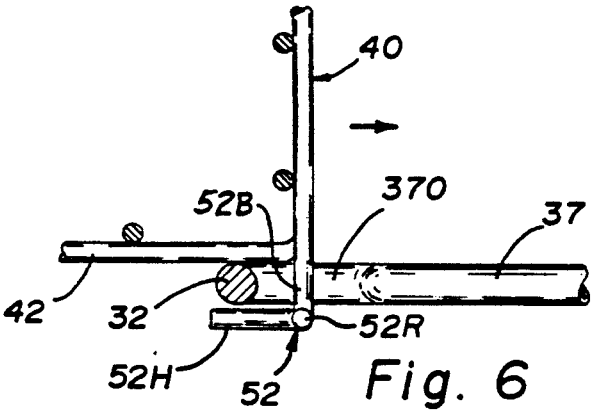
FIG. 6 is a similar view of FIG. 5 showing the drawer in a moved position and illustrating a later step in assembling the two units together.
Figure 7:
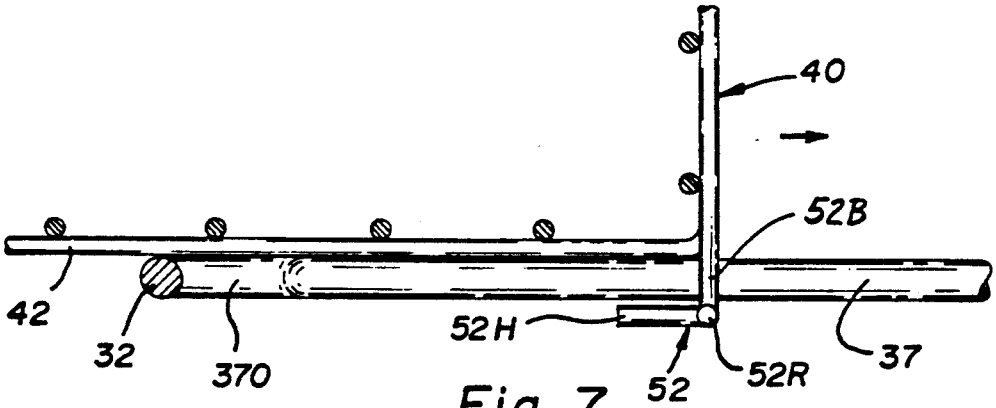
FIG. 7 is a sectional view as was FIGS. 5 and 6 showing the drawer atop the base and partly advanced along the base.

As shown in FIG. 5, the hook portion such as hook 52H of the track engager 50 or 52 readily hooks over the member 32. The drawer 40 may be hung in a more or less vertical angle from the member 32. If the drawer 40 is positioned between the guides 33 (FIG. 2) the hooks 50H, 52H will enter into the openings 350, 370 and the bars 50B, 52B can pass through the opening 350, 370 when the drawer is positioned upward to the horizontal position as shown in FIG. 6. By sliding the drawer in the direction of the arm in FIG. 6 the rods 50R, 52R will pass under the members 37, 38 and 35, 36 as shown in FIG. 7. The rods 50R, 52R are wider than the slot defined by the members and thus the drawer engages the tracks formed by base members.

The drawer being of open weave wire construction allows the contents to be visible to the person standing below.

The steel wire frame of the storage drawer is of substantial strength to hold normal household tools (i.e. electric drill motors, hammers, levels and any other tools that are not "left out" on the work bench).

In the closed or storage position the drawer unit 40 is evenly spaced on the base unit 30. When a person reaches up and pulls the drawer unit 40 horizontally, the drawer unit 40 will slide on the tracks of the base unit 30. The drawer unit 40 slides within the 'walls' of the exposed rafters until the hooks on the bottom rear outside edge of the drawer engage the front rail on crossmember 32 of the carrier frame. The user then lowers the front end of the drawer unit 40. As the drawer unit 40 is lowered, it hangs by the engaged hooks 50H, 52H so the contents in the drawer can then be removed from the now exposed top of the drawer (now an approximately vertical position hanging below the rafters).

The weight of the drawer unit 40 (including the weight of contents of drawer unit 40) is at all times supported by either base unit 30 or hook extension 50H, 52H. The person who is operating the drawer into open or close position is guiding the weight into position, but the drawer unit 40 is designed to hang from the base by the hook extensions without any additional support.

It should now be apparent that a new and improved inter-rafter storage device has been described which is economical to manufacture, easy to install and easy to use.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention. For example, while shown made substantially of welded rigid wire construction, the invention may be practiced, at least in its wider aspects, by use of alternative materials, e.g. high tension strength plastic might be substituted for the wires. Also, a handle could be attached to the drawer's front wall, as is done with many conventional drawers.

I claim:

1. A storage device in combination with adjacent exposed generally parallel rafters, each of which said rafters being of the type that has a generally horizontal surface bottom edge, said combination comprising:

a base unit sized to span across said adjacent rafters and having means for affixing said base unit to each of said adjacent rafters, said base unit including track means defining a track running parallel to said rafters at or near the plane of said bottom edge of said rafters; and a storage drawer unit having a bottom, side walls, rear wall and front wall and having means at the junction between its rear wall and bottom for engaging to said track means whereby said drawer may hang generally vertically from said engaging means from said base unit or be pivoted upward into the space between said rafters and slide along said track means with said engaging means received on said track means so that said drawer unit may assume a storage position substantially between said rafters and above said base unit.

2. The combination of claim 1 wherein:

said base unit and said storage drawer unit are formed of material which allows the contents of the drawer unit, when in the storage position, to be viewed and identified from below.

3. The combination of claim 2 wherein said drawer unit is made of welded rigid wire construction with an open weave which allows its contents to be readily seen and identified when viewed from below.

4. The combination of claim 2 wherein said drawer unit is of generally rectilinear arrangement and also includes a short security lip at its top said lip having adjacent said front wall and spanning between the tops of said side walls for a minor part of the length of said drawer unit but said drawer unit otherwise having an open top.

5. The combination of claim 1 wherein said base unit has means adapted for securing the base unit into said bottom horizontal surface edge of said rafters.

6. The combination of claim 5 wherein said base unit includes a pair of spaced apart crossmembers which are adapted to be secured to the bottom edge of said rafters and said track means include a pair of horizontal members affixed to and spanning between said crossmembers.

7. The combination of claim 6 wherein said horizontal members are rigid wires and there are four such members approximately parallel to each other to form two parallel slots.

8. A storage device in combination with adjacent exposed generally parallel rafters, each of which said rafters being of the type that has a generally horizontal surface bottom edge, said combination comprising:

a base unit sized to span across said adjacent rafters and having means for affixing said base unit to each of the adjacent rafters, said base unit including track means defining a track running parallel to the rafters at or near the plane of the bottom of the rafters; and a storage drawer unit having a bottom, side walls, rear wall and front wall and having means at the junction between its rear wall and bottom for engaging to said track means whereby said drawer may hang generally vertically from said engaging means from said base unit or be pivoted upward into the space between the rafters when said base unit is affixed to the rafters and slide along said track means with said engaging means received on said track means so that said drawer unit may assume a storage position substantially between the rafters and above the base unit;

and wherein said base unit is secured into the bottom horizontal surface edge of rafters and includes a pair of spaced apart crossmembers which are adapted to be secured to the bottom edge of the rafters and said track means include a pair of horizontal members affixed to and spanning between said crossmembers; and wherein said horizontal members are rigid wires and there are four such members approximately parallel to each other to form two parallel slots, wherein said members for engaging is a pair of projections one of which passes through each of said slots and may slide down said slots and over the majority of the length of said wire members serves to prevent the vertical removal of said drawer from said base.

9. The combination of claim 8 wherein said each of projections includes a hook which can engage one of said crossmembers and allow said drawer unit to hang generally vertically from said one crossmember.

10. The combination of claim 9 wherein each of said projections includes a transverse member which is wider than said slots over the majority of the length of said horizontal wires and said horizontal wires are wider apart at one point along their length so as to allow said transverse members to easily pass below said horizontal wires and, by moving the drawer unit along the base unit, to engage said transverse member under said horizontal wire members with the projection passing through said slots.

11. The combination of claim 10 wherein said base is secured to said bottom edge of the rafter by generally vertical screws through the ends of said crossmembers.

12. In combination with a pair of parallel rafters having horizontal bottom edge surfaces at approximately the same height and said pair of rafters being exposed from below, a generally horizontal storage base unit spanning between the rafters and along a length thereof, means for securing the base unit to the horizontal bottom edge of said rafters, a drawer unit sized and shaped to fit above said base unit and between said rafters, means on said drawer and said base for allowing the drawer to slide from a generally horizontal storage position above said base unit and between said rafters to a generally vertical position adjacent said base unit wherein it is hanging from said base unit.

13. The combination of claim 12 wherein said drawer unit may be easily connected or disconnected from said base unit when in said generally vertical position.

14. In combination with a pair of parallel rafters having horizontal bottom edge surfaces at approximately the same height and said pair of rafters being exposed from below, a generally horizontal storage base unit spanning between the rafters and along a length thereof, means for securing the base unit to the horizontal bottom edge of said rafters, a drawer unit sized and shaped to fit above said base unit and between said rafters, means on said drawer and said base for allowing the drawer to slide from a generally horizontal storage position above said base unit and between said rafters to a generally vertical position adjacent said base unit wherein it is hanging from said base unit, wherein said drawer unit may be easily connected or disconnected from said base unit when in said generally vertical position, and wherein said base unit defines a pair of longitudinal and parallel slots which slots are of approximately uniform width for the majority of their lengths but are wider at one end, and said drawer unit includes a pair of projections each of which includes a transverse member generally wider than uniform width of said slots but not wider than the slots at said one end and which projections are so arranged to the drawer unit that they may each easily fit through one of said slots at said one end.

15. The combination of claim 14 wherein said projections also include a hook member for hooking over said base unit of said one end.

16. The combination of claim 15 wherein said base unit and drawer unit are each substantially of welded rigid wire construction.

17. The combination of claim 16 wherein said projections are also formed of rigid wire.

18. The combination of claim 17 wherein said base includes two crossmembers each of which has a flattened end adapted to fit under the horizontal bottom surface of said rafters and said flattened ends are each secured by threaded fasteners into said rafters.

* * * * *